United States Patent [19]

Sitzes

[11] Patent Number: 4,566,197

[45] Date of Patent: Jan. 28, 1986

[54] SHOE CONSTRUCTION

[75] Inventor: Fred B. Sitzes, Cape Girardeau, Mo.

[73] Assignee: Interco Incorporated, St. Louis, Mo.

[21] Appl. No.: 519,339

[22] Filed: Aug. 1, 1983

[51] Int. Cl.[4] ..... A43B 3/14

[52] U.S. Cl. ..... 36/011; 36/68; 36/77 R

[58] Field of Search ..... 36/11, 77 R, 77 M, 68

[56] References Cited

U.S. PATENT DOCUMENTS

| | | | |
|---|---|---|---|
| 95,894 | 10/1869 | George | 36/77 R |
| 96,023 | 10/1869 | Moffitt | 36/68 |
| 147,030 | 2/1874 | Willoughby | 36/68 |
| 248,410 | 10/1881 | Dawes | 36/77 R |
| 264,658 | 7/1953 | Herlihy | 36/19.5 |
| 2,694,870 | 11/1954 | Meltzer | 36/68 |
| 3,711,969 | 1/1973 | Weinstein et al. | 36/68 |

FOREIGN PATENT DOCUMENTS

| | | | |
|---|---|---|---|
| 1213077 | 3/1960 | France | 36/77 R |
| 1573530 | 8/1980 | United Kingdom | 36/77 R |

*Primary Examiner*—Werner H. Schroeder
*Assistant Examiner*—Mary A. Ellis
*Attorney, Agent, or Firm*—Donald J. Fitzpatrick

[57] ABSTRACT

A shoe of the moccasin type is made crush- and deformation-resistant toe by use of a premolded box toe stiffener for stiffening the toe region of the shoe upper. The stiffener is of flexible, resiliently stable character, characteristically remaining in or reverting to its original configuration, including an upstanding flange of curved configuration for lying against and providing securement to the corresponding interior surface of the upper. Principal and side tabs extend rearwardly from the bottom edge of the flange for securement to the sole part of the upper, or to an insole. Exterior foot-opposed surfaces of the stiffener are coated with heat-activated adhesive for adhesive securement to said shoe interior surfaces. The flange has a rear, foot-side inner surface devoid of adhesive, being exposed within the shoe. The method of making the shoe involves thermally forming the stiffener by molding from a blank of heat-formable material.

3 Claims, 9 Drawing Figures

SHOE CONSTRUCTION

BACKGROUND AND SUMMARY OF THE INVENTION

This invention relates to improved shoes of moccasin construction, and, more particularly, is directed to use within the shoe of a so-called box stiffener for providing the toe region with improved resistance to crush and deformation for preventing collapse of the shoe upper in the toe region.

The moccasin type of shoe is characteristically a soft type of shoe wherein a soft leather outsole extends around the sides of the foot and around the toe where it is joined by a U-shaped seam to a soft leather piece extending across the top of the foot. It has a tendency to collapse or to become crushed in the toe region after a relatively short period of wear, causing the toe to bulge out and become exposed to abrasion, resulting in the shortening of the life of the shoe, and seriously degrading its appearance. The moccasin is an increasingly popular type of shoe and, in view of the cost and desire on the part of users to prolong the life of the shoe and maintain its appearance, there is a commercial importance in providing a moccasin type of shoe construction which has enhanced crush and deformation resistance in the toe region but without sacrificing the soft, casual moccasin appearance, or visually revealing any reinforcement structure.

Heretofore, there have been many expedients proposed for the stiffening of the toes or heels of shoes and going back many, many years. Thus, in the early Ely U.S. Pat. No. 87,916, use of leather heel stiffeners was proposed, as was also suggested in the Willoughby U.S. Pat. No. 47,030 of a half decade later. Van Wagenen U.S. Pat. No. 185,803 proposed leather tips for boots and shoes for protecting the shoe upper from wear, while in more recent history, Herlihy U.S. Pat. No. 2,646,584 proposed a shoe construction which included a molded toe box including a vamp assembled with the use of a stiffener blank to provide what the patentee termed a California type shoe having a relatively stiff and shaped end portion; but such shoe was decidedly not of moccasin type. Meltzer U.S. Pat. No. 2,694,870 proposed a moccasin construction but utilizing a prewelded stiffening element adhesively secured between a soft cover and the moccasin body, providing a complex construction not well suited to the modern manufacture of moccasin type shoes, wherein a cover may not be utilized, the moccasin body providing itself the shoe upper. Weinstein U.S. Pat. No. 3,711,969 proposed a thermoplastic shoe stiffener and a method of making same by the forming of thermoplastic PVC, as for use in heel counters and toe boxes. And indeed, toe stiffeners have been long used in shoe construction, as in safety shoes or dress shoes wherein a stiff or rigid toe is desirable, as contrasted with a moccasin as to which it is important to maintain the soft, natural appearance and comfort so characteristic of this type of shoe. In moccasin construction, the use of stiffeners according to the prior art would result in an undesirable outlining, shadowing or lumping on the visible area of the finished shoe, or else render the toe unacceptably stiff or rigid.

It is an object of the invention to provide an improved shoe construction, and particularly the construction for the shoe of the moccasin type having a novel box toe stiffener for bringing about a marked reduction in the tendency of the toe of the shoe to become crushed or otherwise to undergo deformation and thus collapse during usage so as to bulge out, become scuffed and generally abraded.

It is also an object of the present invention to provide such a shoe of moccasin construction which allows assembly by the use of normal manufacturing procedures as heretofore previously utilized for the construction of moccasin type footwear, and whereby the shoe may be constructed with handsewn last or by the utilization of a slip lasted moccasin upper.

It is an object also of the present invention to provide such a shoe of the moccasin type which will retain its shape and revert to its originally formed shape even after extreme crushing, deformation or other abuse, such as heavy pressure or intentional or accidental collapse of the toe.

Further, it is also an object of the invention to provide such a shoe of the moccasin type utilizing a toe stiffener but wherein the toe stiffener does not cause outlining, shadowing or lumping on the visible area of the finished shoe.

Additionally, it is an object of the present invention to provide a relatively economical, easily implemented, commercially advantageous improved method for the construction of moccasin type shoes which are crush- and deformation-resistant.

Briefly, the invention is directed not only to a moccasin type shoe, but also to a method for making same. The shoe includes a shoe upper and a sole part, and may include a full or partial insole, the shoe being provided with a premolded box toe stiffener for stiffening the toe region of the upper to provide crush and deformation resistance. The stiffener, which is molded of thermoplastic material, is of flexible but resiliently stable character for remaining in or reverting to its original configuration. Within the shoe, the stiffener provides an upstanding flange of curved configuration for lying against and providing securement to the corresponding interior surface of the upper within its toe region. The stiffener includes also a central, principal tab extending rearwardly from the bottom edge of the flange for securement to the insole, as well as shorter tabs also extending rearwardly from the bottom edge of the flange and directed toward the principal tab; the side tabs, coplanar with the principal tabs, are each of length which is only part of the rearward extent of the principal tab and are separated from the principal tab by narrow rearwardly opening recesses. The flange has its front, outer (foot-opposed) surface coated with a heat-activated adhesive for adhesive securement to the interior surface of the upper.

According to the preferred method of making such a shoe, there are included the steps of forming the box toe stiffener from a blank of the thermoplastic material, the blank being heated and placed in a mold for providing the above-described configuration, being thereafter cooled to retain the configuration. Thermally activated adhesive is applied only to the outer surfaces of the flange and tab of the stiffener but not to its inner, foot-side surfaces. The stiffener may first be attached to the insole and only thereafter secured to the upper by inserting a last into the shoe. If only a partial insole is utilized, the sole part of the upper may be transversely slit, and the principal tab of the box toe stiffener may then be threaded through the slit. Regardless of how inserted into the upper, the method further then involves pressing the stiffener into and against the toe region and maintaining the shoe in a heated condition, activating the adhesive to provide a strong adhesive bond between the stiffener and the shoe upper. The shoe is thereafter completed by usual manufacturing procedures.

Other objects and features will be in part apparent and in part pointed our later.

BRIEF DESCRIPTION OF THE DRAWINGS

Corresponding reference characters indicated corresponding parts throughout the several views of the drawings.

DESCRIPTION OF THE PREFERRED EMBODIMENTS

Figure 1:
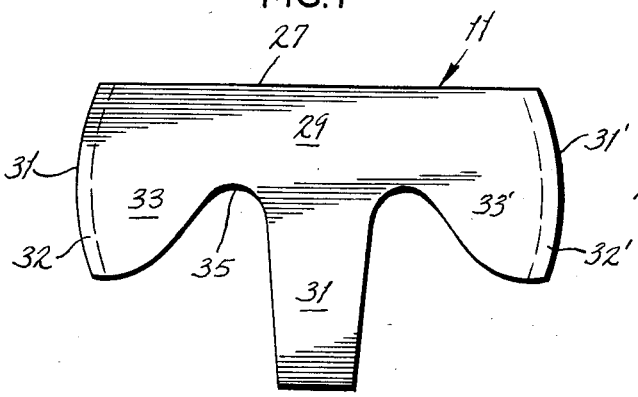
FIG. 1 is a plan view of a blank of resilient, formable material before being formed into a so-called box toe stiffener in accordance with the present invention.

Referring now by reference characters to the drawings, illustrated generally at 11 is a blank of flexible, resiliently stable material of heat formable character. In accordance with the invention, blank 11 is premolded, before utilization in a shoe according to the preferred construction, into a so-called box toe stiffener generally indicated at 13. The stiffener is directly incorporated into the construction of a shoe of moccasin configuration, such as illustrated generally at 15, comprising a conventional shoe upper 17 of the usual type associated with moccasin construction, there being a soft, upstanding peripheral portion 19 of the shoe defining a toe region generally designated 20, together with the soft upper cover or overlying piece 21 which defines the top surface of the shoe, and stitched to the sides around a U-shaped seam 23, as by machines or hand stitching. Such moccasin construction is well-known in the art and a variety of techniques for construction of moccasins may be employed in making shoes according to the present invention.

Moccasin styles of shoes, because of their casual, soft appearance, do tend to exhibit a tendency to being crushed and to undergo deformation, as through pressure, as well as through the forces of wear which ordinarily would cause the toe 25, per se, to collapse and bulge outwardly, and thereby presenting the potential for abrasion in general wear, as well as making the shoe appear to be worn out before its time. However, by the incorporation of the box toe stiffener 13 into the toe region 20, a shoe constructed in accordance with the invention can be made to be crush- and deformation-resistant since the resilient box toe stiffener will cause the toe region 20 to return to its normal configuration, thereby tending to prevent or greatly minimize permanent collapse, bulging or distortion such as would otherwise be inevitable. Such construction makes use of a method of shoe manufacture which is described below.

Blank 11 may be one of a group of resilient, moldable materials including polystyrene; various polymeric synthetic resin materials, such as including polyvinyl chloride; leather; fiber composites; as well as combinations of such materials; and one such material particularly well suited is one of the thermoplastic ionomer resins, cast on a combination woven and unwoven substate and sold commercially under the trade name, "SURLYN". Whatever specific material is selected for blank 11, the material preferrably should exhibit the following properties:

1. In its original flat state, the material should exhibit a resilient, somewhat stiff, crack-resistant, strong character, so that although being sufficiently flexible to be easily handled or formed, will be dimensionally stable and take on a characteristic shape when molded into its desired configuration.

2. The material can be heated such as at temperatures most preferably from 180° to 250° F., to a state in which it can be shaped through molding into a predetermined configuration, preferrably when so heated being soft and pliable.

3. The material should exhibit the capability of being rapidly cooled and/or otherwise treated so that the configuration attained through molding can be suitably retained, but in which state the material will exhibit the same degree of resilient flexibility as it did prior to molding.

4. The material should exhibit a sufficient "memory" so that its shaped configuration subsequent to molding will remain, and so that the resultant box toe stiffener will revert to such originally formed configuration even after extreme abuse during normal wearing such as crushing, pressure or other forces and factors to which a shoe may be exposed.

The ionomer resins well exhibit such properties.

Each blank 11 may be stamped or die cut from a single larger sheet of the selected material, the configuration and dimensions as shown in FIG. 1 being typical of the preferred construction, in which the blank has a substantially rectilinear forward edge 27 which delineates the forward extremity of a forward portion 29 of the blank, which portion defines the principal width of the blank, having outwardly bulging or curved side edges 31, 31'. Extending rearwardly from portion 29 is a tab portion 31 of substantially reduced width and such portion 31 will ultimately define a tab of the box toe stiffener. The side edges 31, 31' are extended rearwardly over at least part of the rearward length of the tab portion 31 for defining ear-like enlarged regions 33, 33' at opposite sides of the blank so that recesses 35, 35' of narrow inverted U-shaped result upon either sides of tab portion 31, the overall plan being rather elephant head-shaped.

The blank 11 may most preferrably have its side edges 31, 31' feather-edge skived to provide a very thin edge at the side margins, as at 32, 32', and preferrably with thickness not greater than about one-half normal thickness of the material for more readily assuring against the possibility of any outlining, shadowing or lumping on the visible area of the upstanding shoe portion 19 in the completed shoe 15. Such skiving may be carried out by customary procedures well known to those skilled in the art of shoe construction.

Figure 2:
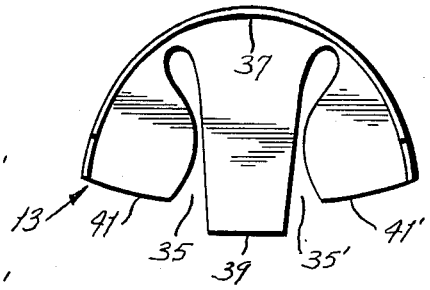
FIG. 2 is a top plan view of a box toe stiffener formed from the blank of FIG. 1.
Figure 3:
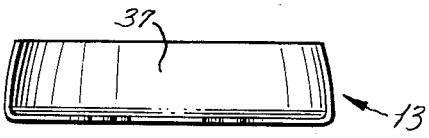
FIG. 3 is a rear elevational view of the box toe stiffener of FIG. 2.
Figure 5:
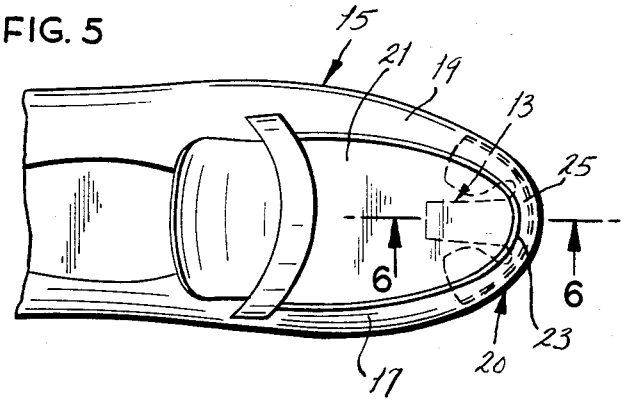
FIG. 5 is a fragmentary top plan view of a shoe of the moccasin type incorporating the new box toe stiffener.
Figure 4:
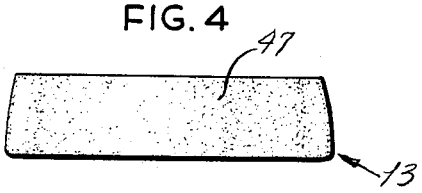
FIG. 4 is a front plan view of the box toe stiffener, showing particularly a layer of heat-activating adhesive or cement with which the outer surface of the box toe stiffener has been coated.

According to the preferred method of the invention, blank 11 is molded into the configuration shown in FIGS. 2–4 to provide the box toe stiffener 13 of this invention. Referring to FIGS. 2–4, box toe stiffener 13, to be used as an element in the ultimate shoe construction, comprises an upstanding flange 37 of curved orientation for conforming generally to the inner surface of shoe upper 15 in the toe region 20, being thus generally shaped like the toe of the shoe. The rearwardly extending portion 31 of blank 11 provides a central tab 39 of trapezoidal, but nearly rectangular orientation, whereas the ear-shaped portions 33, 33' of the blank provide auxiliary side tabs 41, 41' which are directed now, in the curved orientation, toward tab 39 in converging relation while recesses 35, 35' are now substantially narrowed whereby there is provided increased area of contact of the horizontal portions of the box toe stiffener, consisting of tabs 39 and 41'. Tabs 39, 41 and 41' are all coplanar.

Box toe stiffener 13 is formed in this configuration by first heating blank 11 to a temperature of, for example, 180°–250° F. within a heating chamber or oven, while maintaining the blank within a suitable mold or form until the desired configuration, as described above, is obtained. The molded stiffener 13 is then rapidly cooled from the heated state, while still within the mold or form, such as by circulating a liquid coolant throughout the form. Upon cooling, the molded blank retains its configuration as shown in FIGS. 2–4.

Among the various methods for molding blank 11 into the box toe stiffener 13 of this configuration, there may be utilized various heating processes, including steam, electric heating elements, flash heating, forced hot air heating, and the use of reflectorized heating lamps. Although cooling may, as described, be carried out by circulating a liquid coolant through the mold, air cooling also may be utilized.

The molded box toe stiffener 13 may be utilized in a variety of different shoe constructions but most preferrably, as noted, for the construction of a shoe of moccasin type.

For manufacturing a shoe of the moccasin type in accordance with this invention, a moccasin type shoe upper 17 is first provided by the use of known, customary shoe construction methods. The upper may be premulled and formed according to procedures heretofore utilized in the construction of such shoes.

The formed box toe stiffener 13 is coated on its exterior, i.e., foot-opposed surfaces, with thermally activated adhesive of commercially available type. The adhesive is not applied to the inner surfaces, i.e., foot side surfaces, of the stiffener flange 37 but only to the outer surfaces, and specifically the outer surfaces of flange 37 and tab 39, thereby providing a coating 47 of the adhesive for ultimately securing the stiffener within the shoe. Of course, preferably also, the adhesive layer 47 simply is applied to every surface which will be directed outwardly from the foot, such including also tabs 41, 41'. The preferred manner of applying the heat activated adhesive may include brushing, dipping or machine application.

Figure 6:
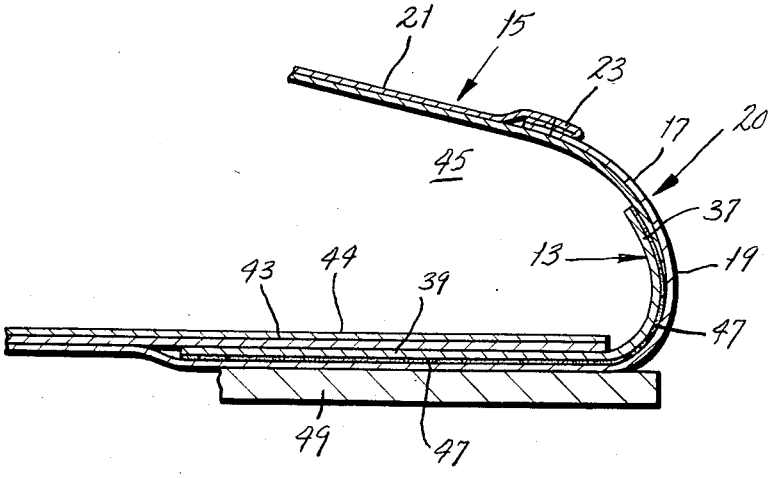
FIG. 6 is an enlarged longitudinal vertical cross sectional view of fragmentary character, as taken generally along line 6—6 of FIG. 5, and with thicknesses being exaggerated.

As is known, a shoe of the moccasin type may have either a full insole or a back part insole only. The utilization of box toe stiffener 13 will depend upon which type of moccasin construction is desired. FIG. 6 illustrates a moccasin 15 wherein the upper 17 is provided with a full insole 43 to which tab 39 has been secured prior to the placement of insole 43, together with a sock liner 44, within the shoe interior 45. This may be accomplished according to one aspect of the method by cutting the forepart of insole 43 from sheet material which is precoated with thermal activating adhesive or by coating the cut insole with a heat activating adhesive. Insertion of insole 43 into the shoe, with the box toe stiffener 13 attached to it, may be carried out by tacking the insole to the last.

Among the procedures which may be utilized optionally for attachment of box toe stiffener 13 to insole 43 may include separately, or in combination, the steps of attaching by tacking, stapling, stitching or the selective application of thermally activating adhesive to selected portions only of tab 39 and tabs 41, 41' which will be covered by the insole, so long as adhesive is not applied to the inner, foot-side surfaces of flange 37, which will be exposed within the shoe.

The method of manufacturing the shoe further includes securing the box toe stiffener 13 within the shoe upper and this is carried out by first pressing the box toe stiffener into and against the inner surfaces of the toe region 20, and this is carried out by inserting the last within the upper.

The lasted upper is then preferably placed within a hot house or other known heating chamber and there exposed to a degree of heat sufficient for activating the adhesive layer 47. According to the preferred method of heating, the last is placed on a multi-station spindle of conventional design which is rotated under a series of heat lamps to bring about the requisite degree of heating. To be certain that activation of the adhesive occurs and appropriate bonding will take place, the lasted shoes are maintained in the heat controlled hot house, or heat setter or other drying device to dry out and ensure activation of the adhesive.

Since adhesive has not been applied to the inner surface of flange 37, the box toe stiffener does not adhere to the last and the last may subsequently be withdrawn without difficulty from the shoe.

Following the period of thermal curing or maintenance within the hot house, etc., the resultant construction is cooled and subsequently utilized normally to complete the shoe, including attachment of the sole 49 and appropriate finishing.

The method of this invention may also be utilized for the construction of shoes of moccasin type which have only a back part insole. In such procedure, the box toe stiffener 13 is not first preliminarily attached to the insole, but rather is attached to the last, such as by tacking or stapling, being then pressed into and against the inner surfaces of the toe region 20 of the shoe; and assembly is continued as described above.

Figure 7:
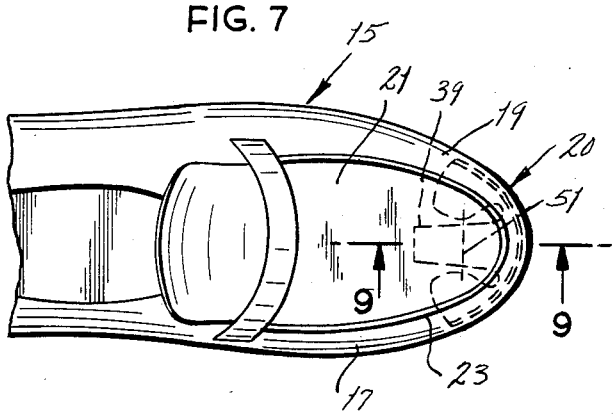
FIG. 7 is a fragmentary top plan view of a different shoe of the moccasin type illustrating an alternative arrangement for securement of the box toe stiffener within the shoe.
Figure 8:
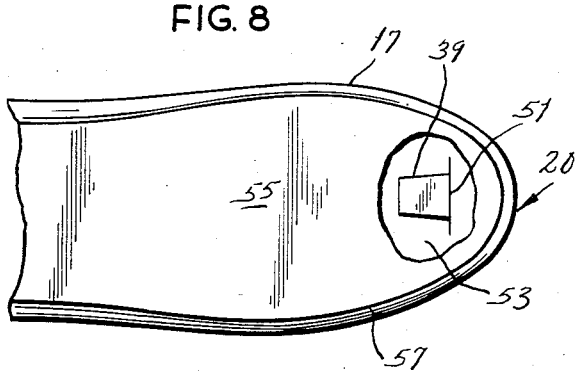
FIG. 8 is a bottom plan view of the shoe of FIG. 7 partly broken away to illustrate the positioning of elements of the box toe stiffener within the shoe.
Figure 9:
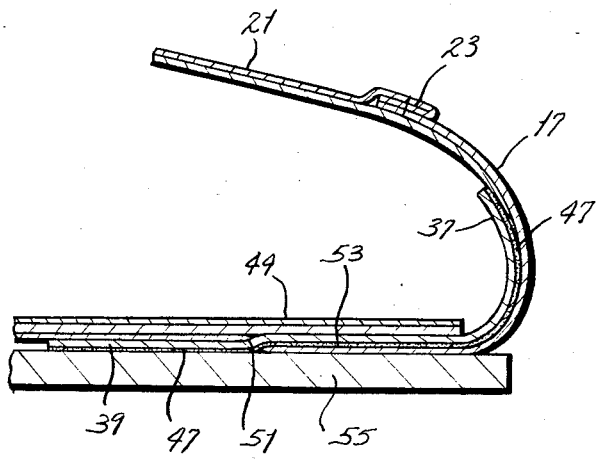
FIG. 9 is a longitudinal vertical cross sectional view, taken generally along line 9—9 of FIG. 7, and illustrating the securement of the box toe stiffener within the shoe of FIG. 7, again with thicknesses being exaggerated.

More preferably, however, a method of securement demonstrated in FIGS. 7–9 is employed. Referring to FIGS. 7 and 8, the shoe upper 17, being of the type for which there will be only a back part insole rather than a full insole, is provided with a small slit or cut 51 in the sole surface 53 of the shoe. Such a shoe may have its sole 55 attached as by the littleway method resulting in the provision of a seam 57 around the sole. Said cut 51 is provided so that it will fall within such seam, and preferably is only slightly greater in length than the width of tab 39 at its widest extremity, and is transverse to the longitudinal axis of the shoe.

As in the methodology described above, the box toe stiffener is precoated with its layer 47 of thermally activated adhesive. A suitable lacing needle may be utilized for insertion of the thus-coated box toe stiffener into the upper, whereby tab 39 is caused to be inserted in the slot 51 as shown in FIG. 8. At this point, the box toe stiffener is preliminarily held by friction to the sole portion 53 and is thus preliminarily retained within the upper in readiness for being pressed into position against the inner surfaces and there adhesively secured.

At this point, the shoe last is inserted into the upper to press the stiffener into and against the inner surfaces of the toe region 19 of the upper, and heating for thermal activation of the adhesive and subsequent steps as described above may be carried out, it being noted that the back part insole is also inserted into the inner and may be adhesively secured in the customary manner. A sock liner 44 is also added.

Thus, in the assembled shoe tab 39 extends rearwardly from flange 37 along the upper surface of sole part 53, being adhesively bonded to it, enters slit 51, then continues rearwardly along the lower surface of sole part 53 to the point of termination.

The shoe manufacturing method of the present invention may be utilized for various types of moccasins and may be utilized equally effectively with shoes which are of last handsewn type or which are of the slip lasted type.

The use and configuration of the box toe stiffener does not interfete with or change the appearance of the finished shoe product in any way, being undetectable in appearance because of the absence of outlining, shadowing or lumping. But the resultant shoe is a superior product, having a crush- and deformation-resistant toe which will maintain its configuration, appearance long after conventional shoes have begun to collapse in the toe region and will not soon exhibit the signs of abrasion and wear which heretofore have been accepted as inevitable with shoes of the moccasin type.

In view of the foregoing, it is seen that the several objects of the invention are achieved and other advantageous results are obtained.

Although the foregoing includes a description of the best mode contemplated for carrying out the invention, various modifications are contemplated.

As various modifications could be made in methods and constructions herein described and illustrated without departing from the scope of the invention, it is intended that all matter contained in the foregoing description or shown in the accompanying drawings shall be interpreted as illustrative rather than limiting.

What is claimed is:

1. A shoe of the moccasin type having a crush- and deformation-resistant toe, the shoe including a shoe upper, and a sole part, and characterized by a premolded box toe stiffener for stiffening the toe region of the upper, the stiffener being of heat-formable material and flexible but resiliently stable character, the stiffener comprising an upstanding flange of curved configuration for lying against and providing securement to the corresponding interior surface of the upper within the toe region thereof, a principal tab extending rearwardly from the bottom edge of the flange for securement to the sole part, the flange having a front, outer surface coated with a heat-activated adhesive for adhesive securement to said interior surface, the flange having a rear, inner surface and directed toward the interior of the shoe;

(i) said box toe stiffener including side tabs extending rearwardly from the bottom edge of the flange at opposite sides of the principal tab for securement also to the sole part;

(ii) said box toe stiffener being formed from a flat blank of resilient formable sheet material, the blank having a substantially rectilinear forward edge, a forward portion of substantial width for defining and forming said flange, a central rearwardly extending portion of reduced width for defining and forming said principal tab;

(iii) said flat blank having ear-like enlarged regions at opposite sides of the forward portion extending rearwardly for part of the rearward length of the rearwardly extending portion for defining and forming the side tabs, the principal tab being centrally located between the side tabs, and (iv) said side tabs being directed toward the principal tab in converging relation, but separated therefrom by rearwardly opening narrow recesses, the side and principal tabs being coplanar, the box toe stiffener including regions of reduced material thickness at opposite side edges of the flange.

2. A shoe of the moccasin type having a crush and deformation-resistant toe, the shoe including a shoe upper, and a sole part, and characterized by a premolded box toe stiffener for stiffening the toe region of the upper, the stiffener being of heat-formable material and flexible but resiliently stable character, the stiffener comprising an upstanding flange of curved configuration for lying against and providing securement to the corresponding interior surface of the upper within the toe region thereof, a principal tab extending rearwardly from the bottom edge of the flange for securement to the sole part, the flange having a front, outer surface coated with a heat-activated adhesive for adhesive securement to said interior surface, the flange having a rear, inner surface and directed toward the interior of the shoe and said sole part having a narrow slit of length approximately the width of the principal tab, the slot being oriented transversely to the longitudinal axis of the shoe and receiving the principal tab from the upper surface of the sole part whereby the principal tab extends rearwardly from the stiffener flange along the sole part upper surface, enters the slit, then extends rearwardly from the slit along the lower surface of the sole part, and terminates beneath the sole part.

3. For use in constructing a shoe of the moccasin type for providing the shoe with resistance to crushing and deformation of the toe, a box toe stiffener formed by molding from a flat blank of resilient heat-deformable sheet material characteristically retaining its molded configuration, the box toe stiffener being of integral, one-piece character and comprising an upstanding flange of curved configuration corresponding to the general shape of the toe region of the shoe, and suited for lying against and securement to corresponding interior surfaces of the shoe toe region, a principal tab centrally extending rearwardly from the flange at its bottom edge, and side tabs extending rearwardly also from the bottom edge of the flange, the side tabs being directed toward but spaced from the principal tab by recesses, the side tabs each having a length which is only a part of the rearward extent of the principal tab, the principal and side tabs being substantially coplanar;

(i) said box toe stiffener further comprising a coating of thermally activated adhesive upon the outer, foot-opposed surfaces of the flange, the principal tab and the side tabs, the adhesive being suitable for adhesively securing the box toe stiffener to the corresponding inner surfaces of the shoe by heating of the shoe, and (ii) said box toe stiffener characterized by side edges of the flange being of reduced thickness, the side tabs being separated from the principal tab by rearwardly opening narrow recesses of inverted U-shaped configuration.

* * * * *